United States Patent [19]

Miller

[11] Patent Number: 4,720,942

[45] **Date of Patent: * Jan. 26, 1988**

[54] APPARATUS FOR ABRADING CONTACT LENS EDGES

[76] Inventor: Jack D. Miller, 5535 19th Ave., North, St. Petersburg, Fla. 33710

[ * ] Notice: The portion of the term of this patent subsequent to Apr. 26, 2004 has been disclaimed.

[21] Appl. No.: 837,816

[22] Filed: Mar. 10, 1986

[51] Int. Cl.[4] ..... B24D 7/18

[52] U.S. Cl. ..... 51/206 P; 51/105 LG; 51/284 E; 51/DIG. 6

[58] Field of Search ..... 51/101 LG, 105 LG, 206 P, 51/206 R, 208, 284 E, 317, 318, DIG. 6

[56] References Cited

U.S. PATENT DOCUMENTS

| | | | |
|---|---|---|---|
| Re. 19,799 | 12/1935 | Elliot | 51/206 P |
| 997,764 | 7/1911 | Eggers | 51/206 R X |
| 2,203,788 | 6/1940 | Jenks | 51/206 R X |
| 2,324,377 | 7/1943 | Fischer | 51/206 R |
| 3,143,829 | 8/1964 | Brauchle | 51/218 R X |
| 3,722,143 | 3/1973 | Cottom | 51/284 E X |
| 3,835,590 | 9/1974 | Hoffman | 51/105 LG |
| 3,882,641 | 5/1975 | Montgomery et al. | 51/317 X |

FOREIGN PATENT DOCUMENTS

| | | | |
|---|---|---|---|
| 588638 | 5/1925 | France | 51/101 LG |
| 2481634 | 11/1981 | France | 51/105 LG |

*Primary Examiner*—Robert P. Olszewski

*Attorney, Agent, or Firm*—Ronald E. Smith

[57] ABSTRACT

An apparatus that abrades the edges of contact lenses. The device has a cone-shaped body portion which has an axis of rotation that coincides with the axis of symmetry of a cone. The body portion is fixedly secured to a spindle member that is engaged by a machine and rotated at high speeds. Annular grooves of differing widths and with differing radii of curvature are formed in the body portion; a polishing compound is deposited into the bottom of a groove to be used and a lens edge is introduced into the groove while the spindle and hence the body portion of the device are rotating. The angle of taper of a particular device corresponds to the dioptric power of the lens to be abraded by it. Accordingly, a cone-shaped member intended to abrade the edges of a lens of high dioptric power will have a higher degree of taper than another device intended to abrade the edges of a lens of low dioptric power.

4 Claims, 5 Drawing Figures

APPARATUS FOR ABRADING CONTACT LENS EDGES

BACKGROUND OF THE INVENTION

1. Field of the Invention

This invention relates,generally, to devices for abrading to marginal edges of hard contact lenses, and more particularly relates to a cone-shaped device provided with a plurality of polish-containing grooves that effects the desired abrading attendant rotation of such device when the edges to be abraded are disposed within the grooves in contacting relation with the polish.

2. Description of the Prior Art

A patentability search that was conducted by the inventor prior to the filing of this disclosure found the following United States patents in the general field of this invention U.S. Pat. Nos. 1,489,606 (1924) to Long; 2,633,788 (1953) to Stuck; 2,693,058 (1954) to Hagstrom; 2,782,570 (1957) to Ische; 3,032,934 (1962) to Johnsa; 3,143,829 (1964) to Brauchle; 3,405,482 (1968) to Brandt and 3,520,091 (1970) to Raphael.

An earlier application disclosing less subject matter than the present application was prosecuted before the Office and the following U.S. patents were located in the course of the Office's search: U.S. Pat. Nos. Re. 19,799 to Elliot (1935); 997,764 to Eggers (1911); 2,203,788 to Jenks (1940); 2,324,377 to Fischer (1943); 3,722,143 to Cottom (1973); 3,835,590 to Hoffman (1974); 3,882,641 to Montgomery and others (1975) and 3,143,829 to Brauchle (1964). Two French patents were also located at that time, to wit: Pat. Nos. 588,638 to Nicole (1925) and 2,481,634 to Briot (1981).

In view of the vast scope and content of the prior art as made apparent by the number of earlier patents, each of which contains numerous teachings and suggestions, it is clear that the most pertinent prior art cannot be identified unless reference is made to the invention itself. Once the present invention is disclosed, those patents of the prior art having the most similarity to the invention can be identified, but the differences between such earlier inventions and the present invention do not define the differences between the present invention and the prior art taken as a whole, of course.

The earlier disclosures identified by the present invention as containing teachings most pertinent to the present invention are the Fischer and Briot disclosures.

Briot teaches the concept of a grinding wheel having a plurality of grooves with different diameters, and Fischer shows that cone-shaped grinding elements are known.

There is a clear need for a device that can polish or otherwise abrade the marginal edges of hard contact lenses. Abrading the lenses gives them a better fit, and in many cases allows them to be worn longer by the eye patient.

There is also a pressing need for such a device that has utility in connection with lenses of differring dioptric powers.

Despite the need for an apparatus or device that will accomplish the desired edge polishing, opticians are currently accomplishing the same by hand.

SUMMARY OF THE INVENTION

The longstanding but heretofore unfulfilled need for a contact lens edge polishing device is now fulfilled in the form of a member constructed of one piece of metal that has been formed into the specific shape disclosed hereinafter. The metal member is designed to be rotated about a spin axis, and the desired abrading is accomplished by bringing the edge of the contact lens to be abraded into contact with a polishing compound that is carried by the device in one or more grooves formed in the metallic member.

The metallic member has a base portion of conical configuration, and the grooves that contain the polishing compound at the bottom thereof are longitudinally spaced from one another and are formed in the base portion itself. The grooves are parallel to one another and are orthogonally disposed relative to the spin axis of the device.

The device further includes a stem or spindle portion that has the same spin axis as the base portion, and conventional motor means are employed to engage and spin the spindle portion of the inventive device to effect concomitant rotation of the groove-carrying base portion.

As the base portion spins, a contact lens oriented so that its optical axis is parallel to the spin axis of the base portion is positioned relative to the device so that the marginal edges of such lens is received by a preselected groove and so that the edge to be abraded comes into operative contact with the polishing compound in the selected groove.

Since the grooves are formed in a cone, the optician can select grooves of varying diameters within which to position the lenses to achieve the effect desired.

Moreover, the cone is divided into a first proximal section and a second distal section, such sections being separated by an annular zone having a taper greater than the taper of the cone in general. This provides a set of distal grooves of substantially reduced diameter relative to the diameters of the grooves located proximally of the annular zone.

One cone can abrade a number of different lenses, in view of the different sizes of grooves available on a single cone; however, it has been found that the angle of the cone used to abrade a lens of high dioptric power should be greater than the angle of a cone used in abrading the edges of a lens of lower dioptric power. For this reason, a family of cones is provided by the present invention. Cones having greater angles of taper are used when the edges of high dioptric power lenses are abraded, and cones of reduced taper are used in connection with lenses of reduced dioptric powers.

Moreover, a family of different cones is also provided within each family of cones of common taper; the radius of the arc that forms the bottom of the grooves can thus be varied as between different cones of similar taper.

It is therefore clear that the primary object of this invention is to provide a device capable of grinding the marginal edges of hard contact lenses.

Another object is to provide the needed device in the form of a device having no moving parts so that such device can be economically manufactured.

It is also an object of this invention to provide a versatile lens grinding device so that the optician can grind many different types of hard contact lenses.

The invention accordingly comprises the combination of elements, features of construction, and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

DETAILED DESCRIPTION OF THE PREFERRED EMBODIMENT

Figure 1:
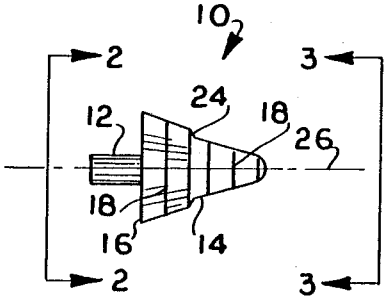
FIG. 1 is a side elevational view of a lens cone constructed in accordance with the teachings of this invention.

Referring now to FIG. 1, it will there be seen that an embodiment illustrative of the invention is designated by the reference numeral 10 as a whole. The device 10 is of one piece construction, and is preferably metallic. It could be solid or hollow with relatively thick walls to allow for the formation of grooves therein, as hereinafter set forth.

It should be understood that the present invention includes a family of devices 10, but since all have the same general appearance, only one member of the family of devices is shown.

Figure 2:
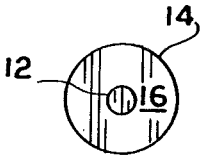
FIG. 2 is a rear end view thereof, taken along the line 2—2 of FIG. 1.

The device 10 includes a rod-shaped spindle member 12 which is integrally formed with a conical in configuration base member 14. As viewed in FIG. 1, the left end of the device 10 will be referred to as the proximal end, and the right end will be referred to as the distal end. The annular flat surface 16 that forms the proximal end of base 14 has a diameter greater than the diameter of spindle 12, as shown in FIGS. 1 and 2. Spindle 12 and base 14 share a common spin axis 26.

A plurality of grooves, collectively desginated 18, are formed in the base member 14. The grooves are longitudinally spaced and parallel to one another, but need not be equidistantly spaced. Moreover, the number of grooves could be as few as one, and FIG. 1 should be interpreted as showing a single groove formed therein as included in the actual depiction.

Figure 4:
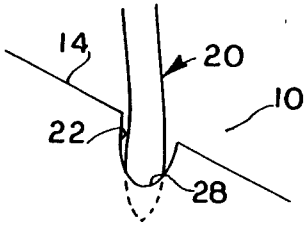
FIG. 4 is an enlarged view showing a single groove in side elevation with a lens undergoing abrasion disposd therein; the abraded, removed portions of the lens are represented by phantom lines in FIG. 4.

The grooves are of sufficient (longitudinally extending) width to receive therein the edges of a hard contact lens 20, as shown in FIG. 4. Each groove, in an embodiment having more than one groove, could be formed so that the pitch of the sidewalls of the respective grooves would be different. In other words, the exact profile indicated by the numeral 22 of groove 18 would differ from groove to groove so that the optician could select from a number of grooves when edge abrading is desired.

An annular region 24 is formed on the base 14 slightly proximal of the medial portion of such base 14, as shown in FIG. 1. This annular region 24 is the demarcation line between the proximal region of base 14 which has a relatively large diameter and the distal region of the base which has a relatively small diameter. In both regions, the diameter of base 14 progressively diminishes at substantially the same rate, but the increased taper of the annular region 24 enables the sets of proximal grooves 18 and the sets of distal grooves 18 to have substantially dissimilar diameters vis a vis the difference in diameters which would be provided in the absence of the accelerated taper region 24.

When it is desired to abrade the edges of a contact lens, a suitable compound such as silver polish is deposited in operative amounts in the grooves 18. Spindle 12 is connected in driven relation to a motor means, not shown, that rotates the spindle and hence base 14. A lens, such as the lens 20 appearing in FIG. 4, is aligned so that its optical axis is parallel to the spin axis 26 (FIG. 1) of the device 10, and the edge to be abraded is advanced into the groove 18 that has been selected. The simultaneous rotation of base 14, groove 18 and the compound (not shown) deposited within such groove at the bottom thereof will abrade the edge of the lens due to relative movement between the rotating compound and the stationary lens edge. The phantom lines in FIG. 4 depict the portion of lens 20 that has been removed from the lens through abrasion. Clearly, then, the concave contour 22 of grooves 18 will produce a matching convex contour 28 on the lens edge.

Similarly, if different convex contours are desired to be formed on a lens, a different groove 18 will be selected as the edge abrading groove. It is also apparent that any quantity of the lens edge may be removed, as selected by the optician.

Figure 5:
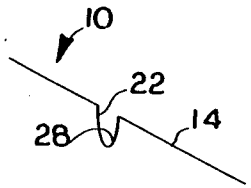
FIG. 5 is a view similar to that of FIG. 4, but it differs by depicting a radius of curvature for the bottom of the groove that is less than the corresponding portion of the groove shown in FIG. 4, and it also depicts a groove of narrower width.

The radius of the arc used to form the bottom of each groove 18 may be varied between different devices 10; in other words, the grooves 18 on a particular cone 10 may have a different radius than that of other cones 10; the reference numeral 28, indicated hereinabove as denoting the convex edge of a lens abraded by the inventive device, is also used to indicate the radius of curvature of a groove. FIG. 5 depicts a radius of curvature greater than that shown in FIG. 4. The width of the groove shown in FIG. 5 is also less than that of FIG. 4.

Moreover, the angle of the cone 10 shown in FIG. 5 is a little less than the angle of the cone shown partially in FIG. 4; accordingly, a lens of less dioptric power would be abraded by the device of FIG. 5. Those skilled in the art of optics wil appreciate that a lens having a lower dioptric will be a thinner lens; thus, the reduced taper of the cone of FIG. 5 is accompanied by the increase in radius of the groove as at 28.

Figure 3:
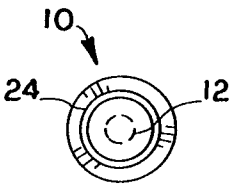
FIG. 3 is a front end view thereof, taken along the line 3—3 of FIG. 1.

Although not drawn to scale and to actual size, FIGS. 1–3 generally depict the actual size of a commercial embodiment of the invention. The device 10 is thus seen to be small, light in weight, and therefore capable of being rotated at high speeds if desired in the edge abrading process. Although the invention has been described in the context of a hard contact lens, it is clear that a larger version of the illustrated embodiment could be employed to accomplish edge abrading of full size lenses.

It will thus be seen that the objects set forth above, and those made apparent by the foregoing description, are efficiently attained, and since certain changes may be made in the above construction without departing from the scope of the invention, it is intended that all matters contained in the foregoing description, or shown in the accompanying drawings, shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A device for abrading the edges of a contact lens, comprising:

a generally cone-shaped member having an axis of rotation corresponding to a longitudinal axis of symmetry of the cone;

said cone-shaped member being formed of two distinct cone-shaped sections extending along said longitudinal axis with the degree of taper in the longitudinal direction of a first and second one of said cone-shaped sections being the same with an annular region of substantially greater degree of taper connecting the first and second sections;

a plurality of independent annular grooves formed in each of said cone-shaped sections at longitudinally spaced intervals along their extent;

each of said grooves having a different width for abrading contact lens edges having different thicknesses;

each of said grooves having a different concave in configuration radius of curvature at its lowermost region for abrading contact lens edges to obtain desired radius of curvature of the lens edges.

2. The device of claim 1, wherein, the annular region is arranged so that the respective diameters of the grooves formed in the first cone-shaped section on a first side of said annular region are substantially different from the respective diameters of the grooves formed in said second cone-shaped section on a second side of said annular region.

3. The device of claim 2, further comprising a machine-rotatable spindle member fixedly secured to said cone-shaped member at its axis of rotation so that rotation of said spindle member effects simultaneous and corresponding rotation of said cone-shaped member.

4. The device of claim 3, further comprising a polishing compound deposited at the lowermost region of said respective grooves.

* * * * *